US007014057B2

(12) United States Patent
Wang

(10) Patent No.: US 7,014,057 B2
(45) Date of Patent: Mar. 21, 2006

(54) COLLAPSIBLE CONTAINER

(76) Inventor: Hui-Min Wang, F 16-1, No. 266-2, Sec. 1, Jhongshsing Rd., Sindian City, Taipei County (TW) 231

( * ) Notice: Subject to any disclaimer, the term of this patent is extended or adjusted under 35 U.S.C. 154(b) by 350 days.

(21) Appl. No.: 10/671,053

(22) Filed: Sep. 22, 2003

(65) Prior Publication Data

US 2005/0061811 A1 Mar. 24, 2005

(51) Int. Cl.
*B65D 6/16* (2006.01)

(52) U.S. Cl. ..... 220/7; 220/6; 220/4.29

(58) Field of Classification Search ..... 220/6, 220/7, 4.28, 4.29; 229/117.08, 117.01, 189; 190/107

See application file for complete search history.

(56) References Cited

U.S. PATENT DOCUMENTS 3,900,157 A * 8/1975 Roth ..... 206/737
4,397,388 A * 8/1983 Quaranta ..... 206/309
5,195,644 A * 3/1993 Schmid ..... 220/6
5,372,256 A * 12/1994 Chen ..... 206/425
5,472,107 A * 12/1995 Lieber ..... 220/6
6,223,922 B1 * 5/2001 Amatangelo ..... 220/6
6,619,496 B1 * 9/2003 Appelbaum ..... 220/7

* cited by examiner

*Primary Examiner*—Nathan J. Newhouse
*Assistant Examiner*—Eugene Lhymn

(57) ABSTRACT

A collapsible container includes a rectangular bottom, a front and a rear rectangular wall pivotally turnably connected to a front and a rear edge, respectively, of the bottom along two folding lines, two rectangular side walls pivotally turnably connected to two lateral ends of each of the front and the rear wall along two folding lines, and two locating flaps pivotally turnably connected to two lateral edges of the bottom along two folding lines. Each of the two locating flaps is an isosceles triangle having two equal lateral sides separately corresponding to a diagonal of the side wall. Moreover, fastening elements are correspondingly provided on an inner surface of each side wall and an outer surface of the locating flap to enable detachable connection of the side walls to the locating flaps and accordingly free collapse and extension of the container.

8 Claims, 11 Drawing Sheets

COLLAPSIBLE CONTAINER

FIELD OF THE INVENTION

The present invention relates to a collapsible container, and more particularly to a container that may be collapsed for easy storage when it is not in use and extended again for use at any time.

BACKGROUND OF THE INVENTION

FIG. 1 shows a conventional container structure that usually includes a rectangular container 30 and a corresponding cover cap 40. Both the container 30 and the cover cap 40 are typically made of metal material, plastics, cardboard, or other suitable materials either through integral molding or bending the material in a predetermined manner. However, either the integrally molded or the bent container 30 and cover cap 40 are not collapsible to a reduced volume. Conventional cartons are one example of this type of container structure, and could not be collapsed without tearing apart and thereby damaging joints of different parts of the cartons, making the collapsed cartons incomplete and ugly.

When the above conventional container structure consisting of a container 30 and a cover cap 40 is initially produced, a large space is required to store and transport it. And, when the container and the cover cap are not in use, they could not be conveniently collapsed for storage.

SUMMARY OF THE INVENTION

A primary object of the present invention is to provide a collapsible container, so that the container could be collapsed when it is not in use to facilitate easy storage and transport thereof, and extended again at any time for containing different articles as desired.

Another object of the present invention is to provide a collapsible cover cap for removably closing an open top of the above-mentioned collapsible container without increasing the volume of the container when it is collapsed for storage or transport.

To achieve the above and other objects, the collapsible container of the present invention includes a rectangular bottom, a front and a rear rectangular wall pivotally turnably connected to a front and a rear edge, respectively, of the bottom along two folding lines, two rectangular side walls pivotally turnably connected to two lateral ends of each of the front and the rear wall along two folding lines, and two locating flaps pivotally turnably connected to two lateral edges of the bottom along two folding lines. Each of the two locating flaps is an isosceles triangle having two equal lateral sides separately corresponding to a diagonal of the side wall. Moreover, fastening means are correspondingly provided on an inner surface of each side wall and an outer surface of the locating flap to enable detachable connection of the side walls to the locating flaps and there by permitting free collapse and extension of the container at any time.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention relates to a collapsible container 1 and a collapsible cover cap 2 for the container 1.

Figure 1:
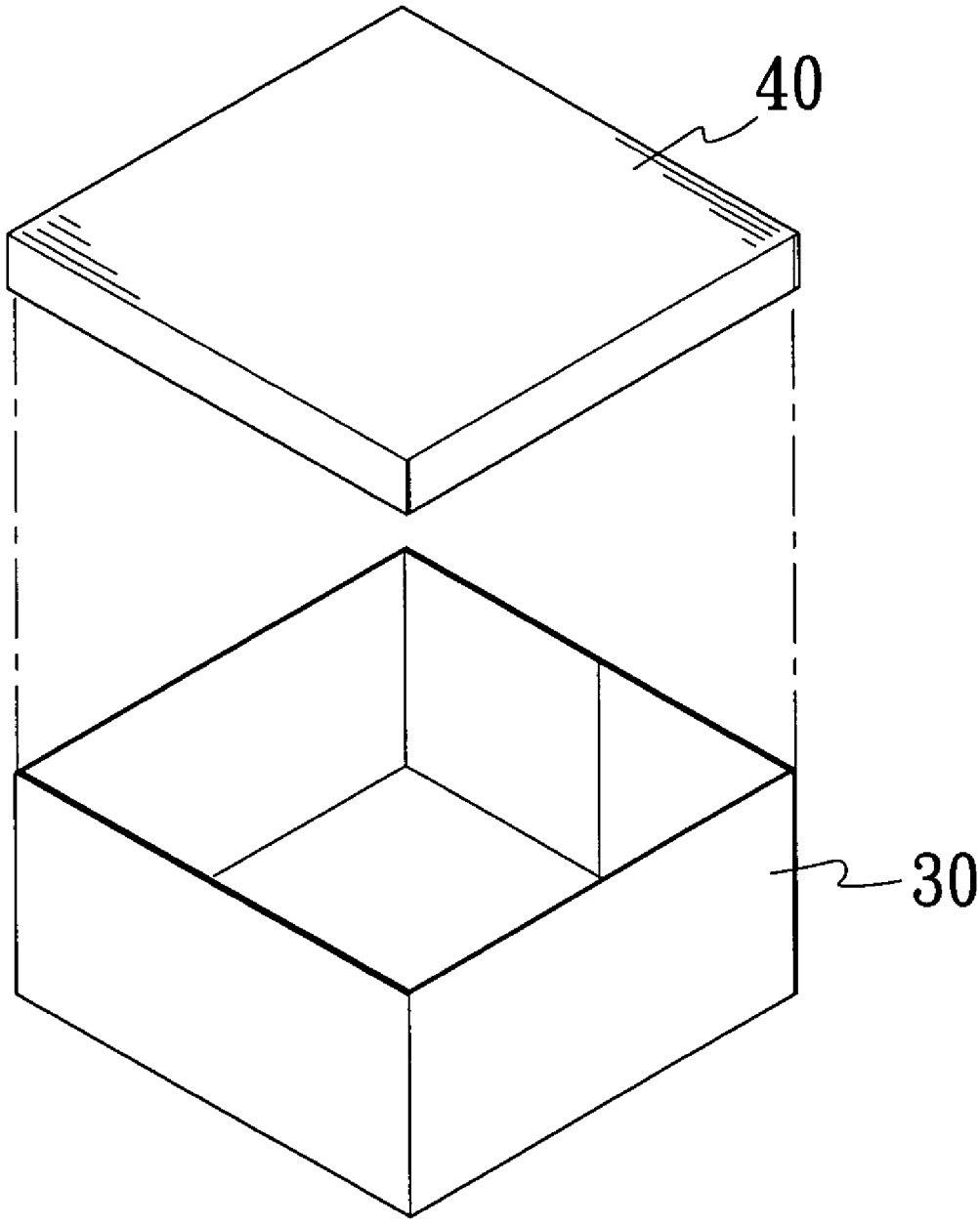
(PRIOR ART) Fig. 1
FIG. 1 is a perspective view of a conventional container and a cover cap thereof.
Figure 2:
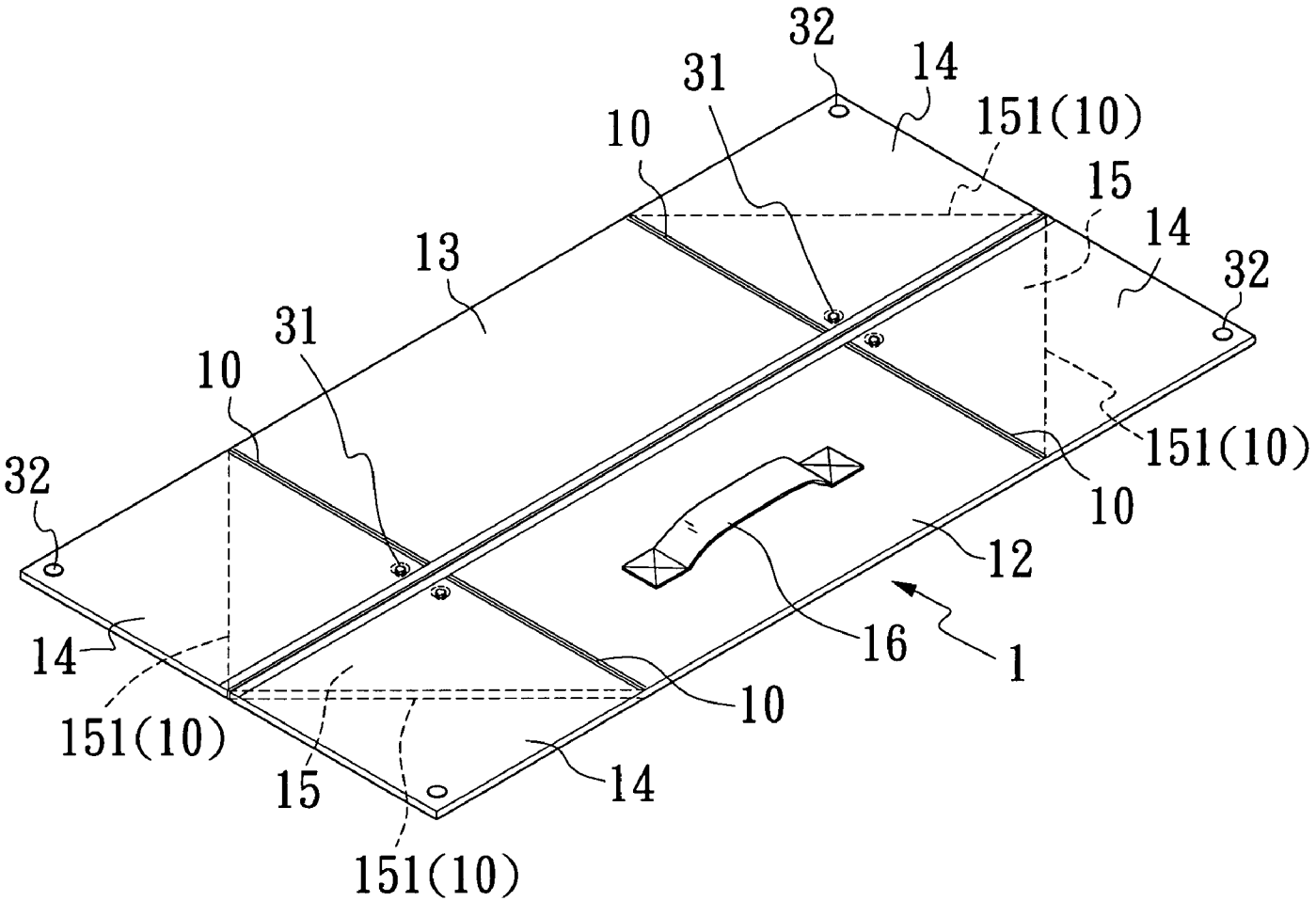
FIG. 2 is a top perspective view of a container according to a first embodiment of the present invention in a collapsed state.
Figure 3:
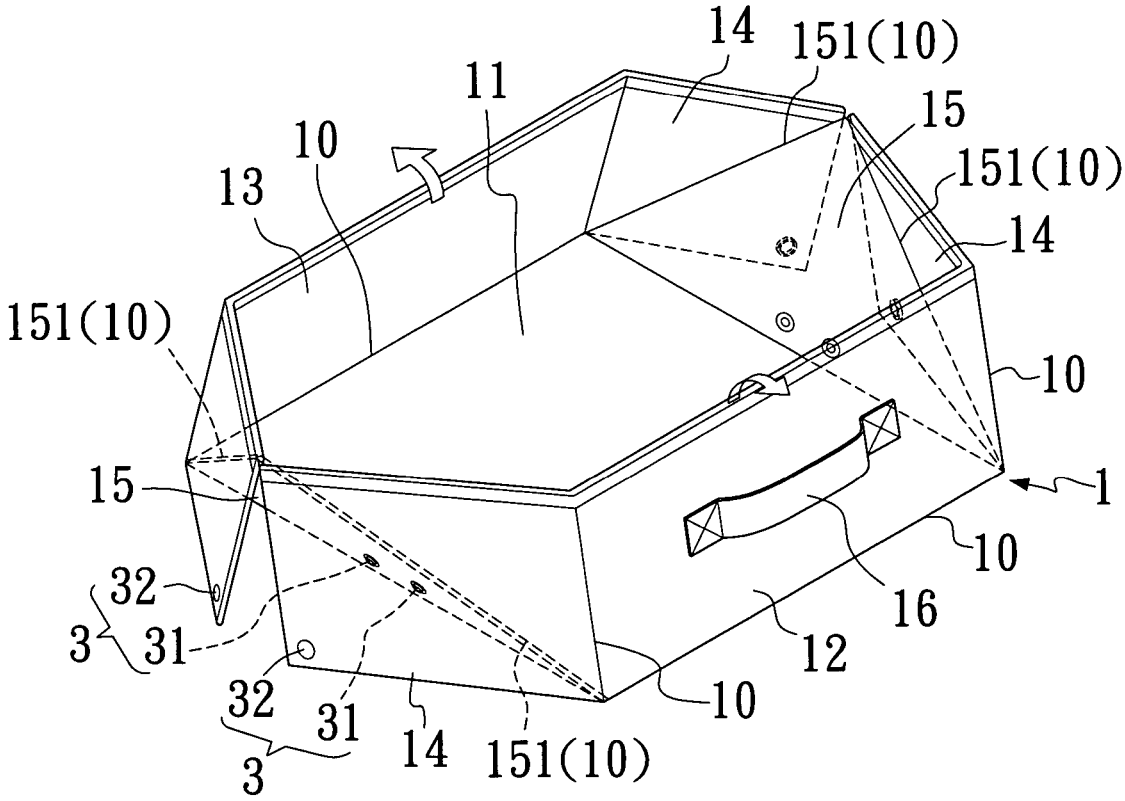
FIG. 3 is a perspective view showing the manner of turning and folding different parts of the collapsed container of FIG. 1 to provide an extended container for use.
Figure 4:
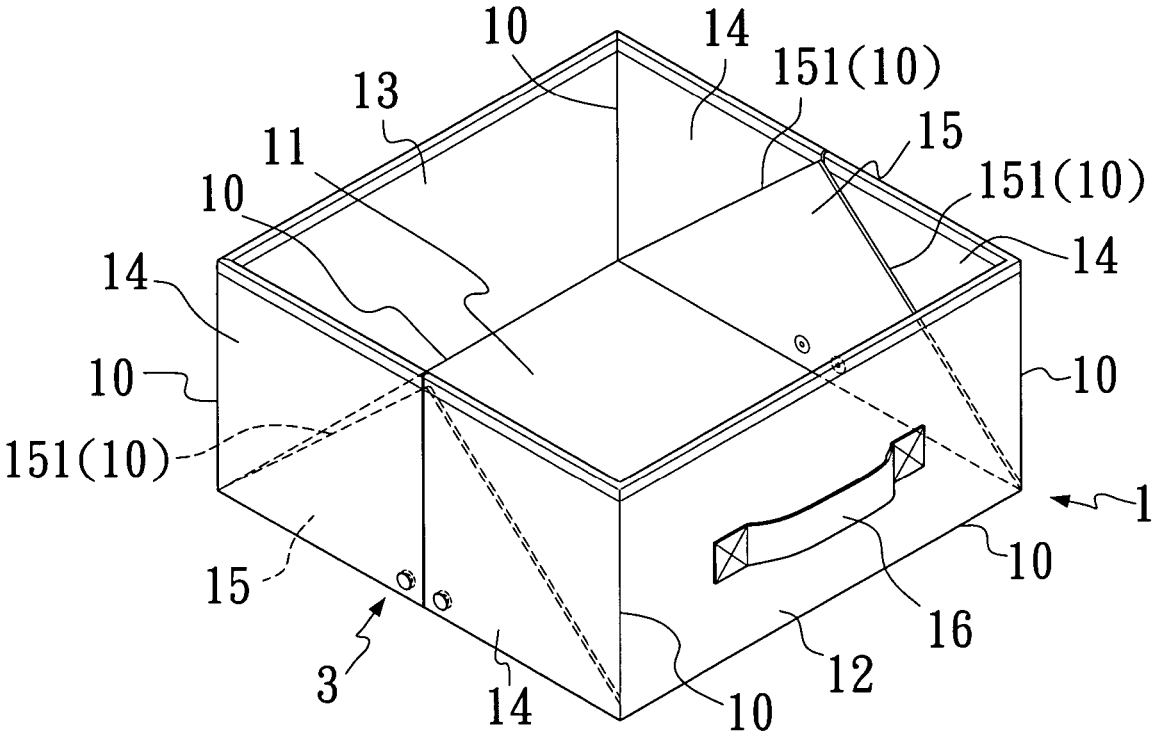
FIG. 4 is a perspective view of the container of the first embodiment of the present invention in a fully extended state for use.

Please refer to FIGS. 2 to 4 in which a collapsible container 1 according to a first embodiment of the present invention is shown. As shown, the container 1 mainly includes a rectangular bottom 11, a front and a rear rectangular wall 12, 13 pivotally turnably connected to a front and a rear edge, respectively, of the bottom 11 along two folding lines 10, two rectangular side walls 14 pivotally turnably connected to two lateral ends of each of the front and the rear wall 12, 13 along two folding lines 10, and two locating flaps 15 pivotally turnably connected to two lateral edges of the bottom 11 along two folding lines 10. Each of the side walls 14 has a width, that is, a length of the side wall extended from the lateral end of the front or the rear wall, that does not exceed one half of an overall length of each lateral edge of the bottom between the front and the rear edge. Each of the two locating flaps 15 is an isosceles triangle having two equal lateral sides 151 separately corresponding to a diagonal of the side wall 14. Moreover, two detachably connectable mating fastening elements forming a fastening means 3 are correspondingly provided on an inner surface of each side wall 14 and an outer surface of the locating flap 15.

Figure 5:
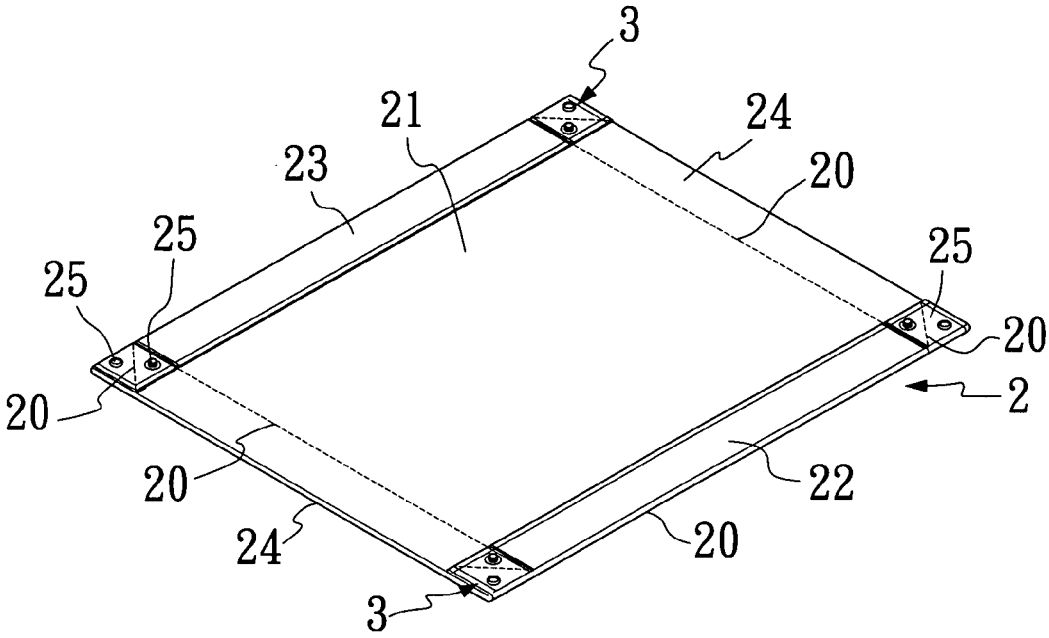
FIG. 5 is a perspective view of a cover cap for the container of FIG. 4 in a collapsed state.
Figure 6:
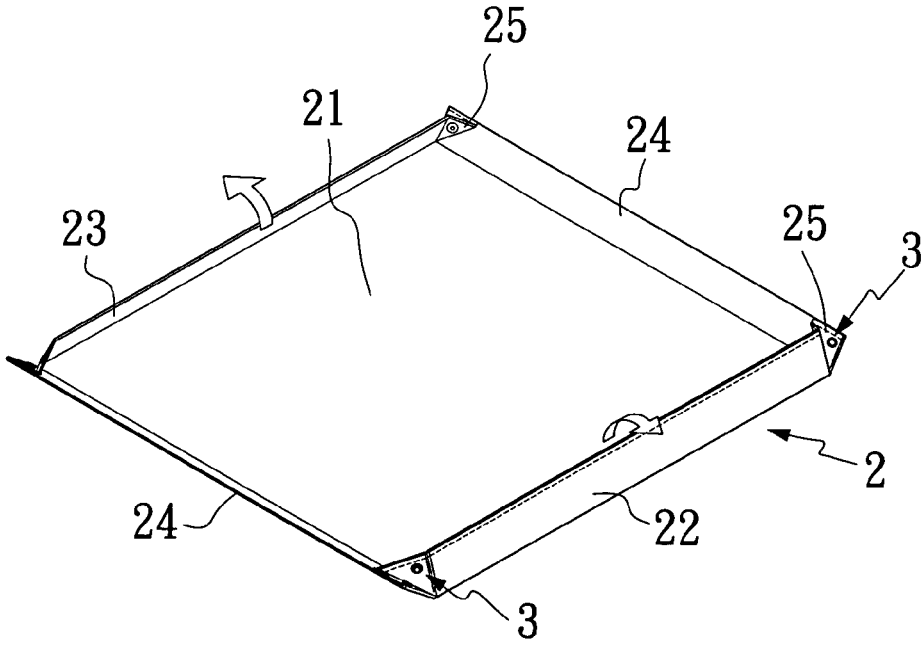
FIG. 6 is a perspective view showing the manner of turning and folding different parts of the collapsed cover cap of FIG. 5 to provide a cover cap for use.
Figure 7:
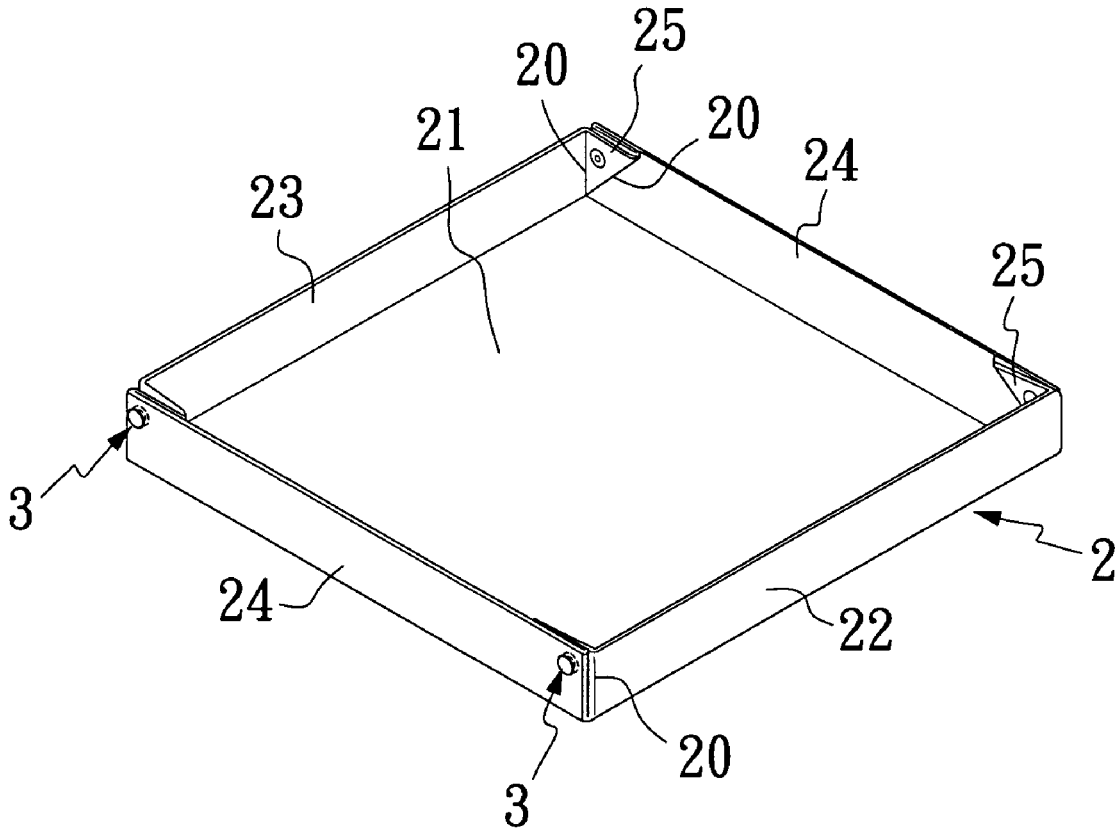
FIG. 7 is a perspective view of the cover cap of the present invention in a fully extended state for use.

Please refer to FIGS. 5 to 7 in which a collapsible cover cap 2 according to the present invention is shown. As shown, the cover cap 2 mainly includes a rectangular top 21, a front and a rear skirt 22, 23 pivotally turnably connected to a front and a rear edge, respectively, of the top 21 along two folding lines 20, a side skirt 24 pivotally turnably connected to each lateral edge of the top 21 along a folding line 20, and two triangular connecting pieces 25 pivotally turnably connected two lateral ends of each of the skirts 22, 23, 24. Any two of the triangular connecting pieces 25 that are located between two adjacent skirts 22, 24 or 23, 24 are integrally connected to and foldable toward each other along a folding line 20. Moreover, two mating fastening elements that together form a fastening means 3 are provided on any two adjacent triangular connecting pieces 25 at their outer surfaces that would face toward each other after the two adjacent triangular connecting pieces 25 are folded along the folding line 20 to extend into the cover cap 2.

Figure 8:
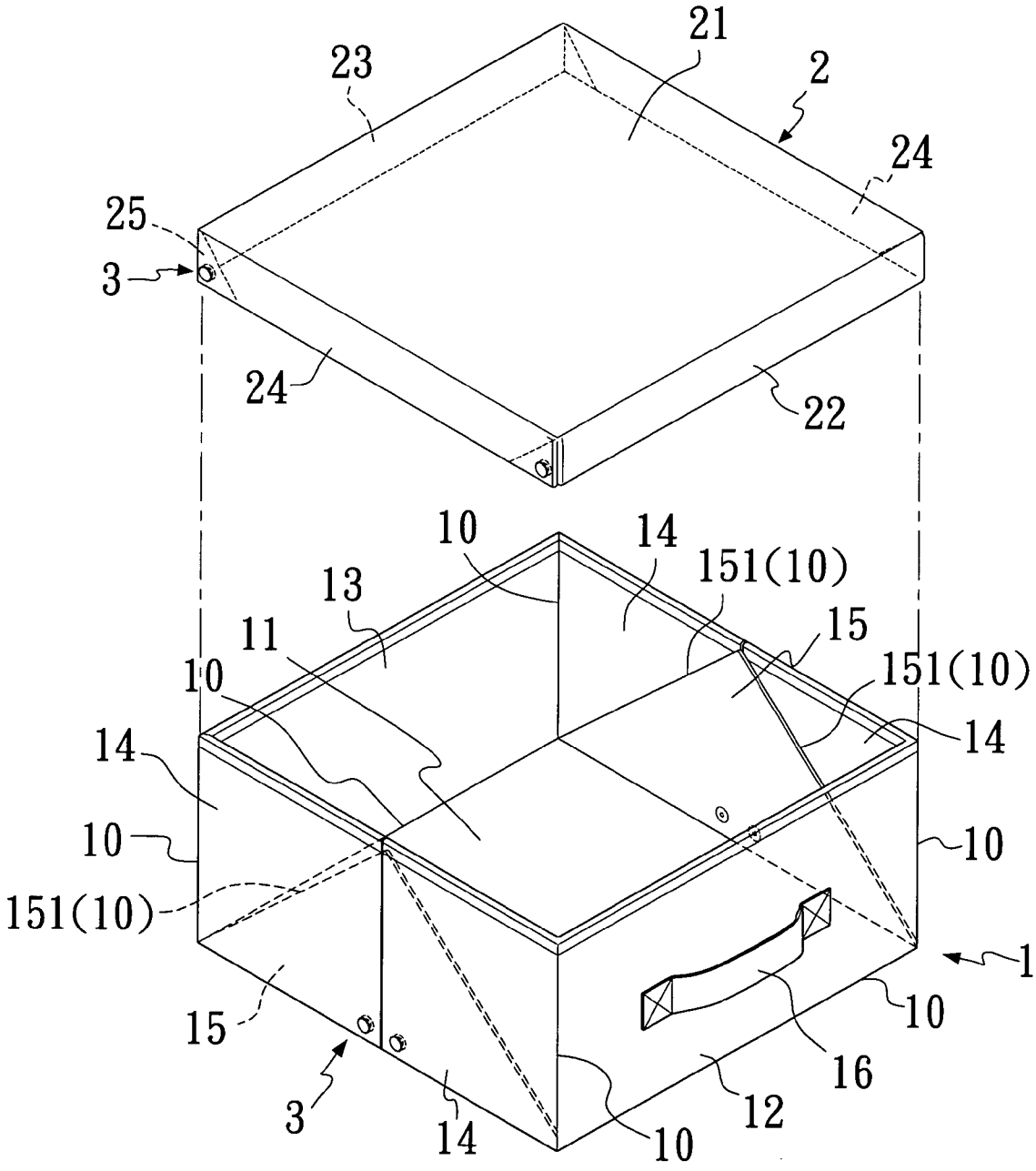
FIG. 8 shows the use of the cover cap of FIG. 7 to cover an open top of the container of FIG. 4.

FIG. 8 shows the container 1 and the cover cap 2 of the present invention in a fully extended state for use.

In the case the container 1 and the cover cap 2 are integrally formed from a cardboard, the folding lines 10, 20 maybe formed by means of pre-folding the cardboard at predetermined positions. Or, in the case the container 1 and the cover cap 2 are integrally formed from a plastic board, the folding lines 10, 20 may be formed by means of integrally forming thinner portions on the plastic board at predetermined positions.

Alternatively, the container 1 and the cover cap 2 may be made of a sheet metal, a plastic board, or a cardboard to include separated parts, including the bottom 11 and the walls 12, 13, 14, and the top 21 and the skirts 22, 23, 24, and cloth or non-woven fabric is attached to inner or outer surfaces of these separated parts to connect them together and form the complete container 1 and cover cap 2. In the latter case, the cloth or the non-woven fabric provides bendable folding lines 10, 20 at joints of any two adjacent parts.

When the container 1 having the above-described structure is initially produced and has not been used to hold anything, it may be collapsed by means of pivotally turning the front and the rear wall 12, 13 toward an upper side of the bottom 11, as shown in FIG. 2. At this point, the side walls 14 and the locating flaps 15 are automatically brought to a lying position, so that the whole container 1 is in a completely flat state to largely reduce the space needed to store, transport, or display the container 1. And, when it is desired to use the container 1, a user needs only to turn the front and the rear wall 12, 13 from the flat position into an upright position, so that the sidewalls 14 and the locating flaps 15 are automatically brought to the upright position at the same time, as shown in FIG. 3. Thereafter, use the fastening means 3 to hold the two side walls 14 and the one locating flap 15 at the same lateral side of the container 1 in a firmly connected state, as shown in FIG. 4. Then, the container 1 is ready for use. And, when the container 1 is not in use, the fastening means 3 on the side walls 14 and the locating flaps 15 may be detached for the container 1 to be collapsed into the fully flat state again by turning the front and the rear walls 12, 13 to the upper side of the bottom 11.

Similarly, when the cover cap 2 having the above-described structure is initially produced and has not been used to cover the container 1, it may be collapsed by means of pivotally turning the front and the rear skirt 22, 23 toward a lower side of the top 11, and pivotally turning the two lateral skirts 24 outward to a lying position, as shown in FIG. 5, so that the cover cap 2 is in a flat state to occupy a largely reduced space. When it is desired to use the cover cap 2, a user needs only to turn the front, the rear, and the lateral skirts 22, 23, 24 to an upright position, fold and orient the two adjacent triangular connecting pieces 25 at each lateral end of the skirts 22, 23, 24 toward the top 21, as shown in FIG. 6, and use the fastening means 3 to hold the folded adjacent connecting pieces 25 in a fitly contacted position, as shown in FIG. 7. Then, the cover cap 2 is ready for use.

Figure 12:
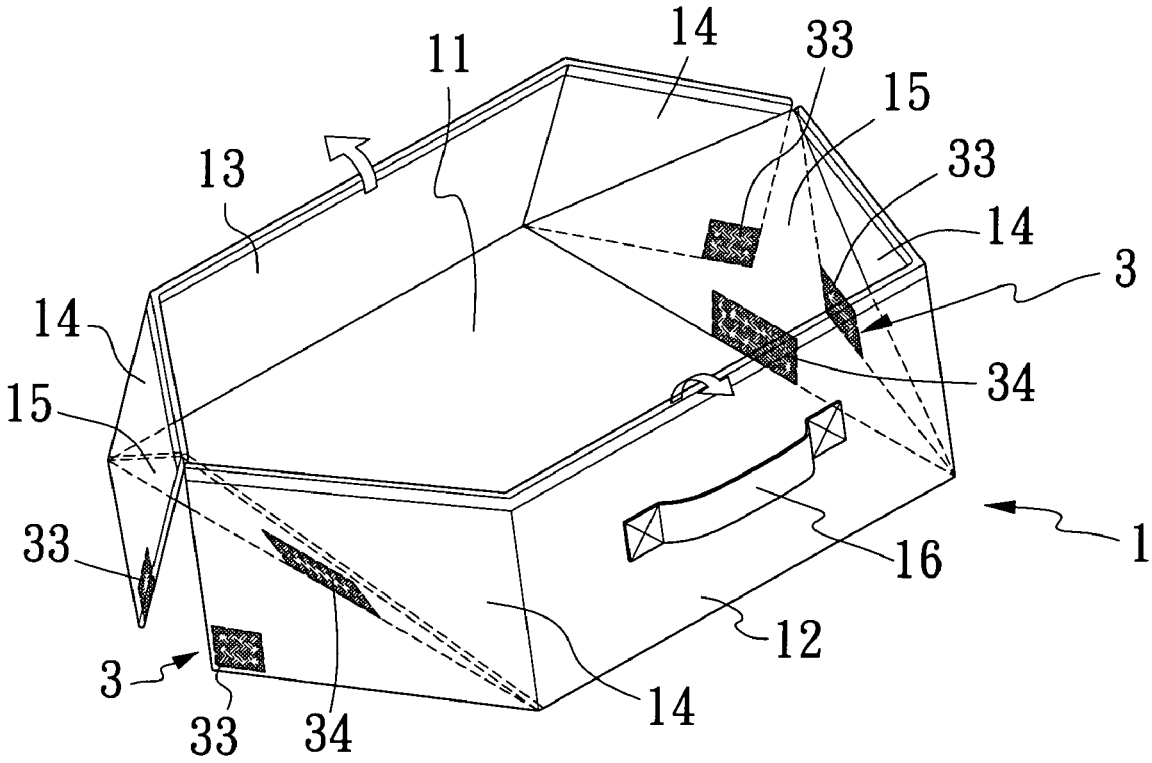
FIG. 12 shows one type of fastening means used in the present invention.

The fastening means 3 including two mating fastening elements may be a snap including a ball side 31 and a socket side 32 that are separately and correspondingly fixed to an inner surface of the side wall 14 and an outer surface of the locating flap 15 on the container 1, and outer surfaces of any two adjacent connecting pieces 25 on the cover cap 2, as shown in FIGS. 3 and 5, so as to hold the container 1 and cover cap 2 in the extended state for use. Alternatively, the fastening means 3 may be a magic tape (that is, Velcro tape) consisting of a hook tape 33 and a loop tape 34, as shown in FIG. 12. Similarly, the hook tape 33 and the loop tape 34 are separately and correspondingly fixed to an inner surface of the side wall 14 and an outer surface of the locating flap 15 on the container 1, and outer surfaces of any two adjacent connecting pieces 25 on the cover cap 2, so as to hold the container 1 and cover cap 2 in the extended state for use.

Figure 9:
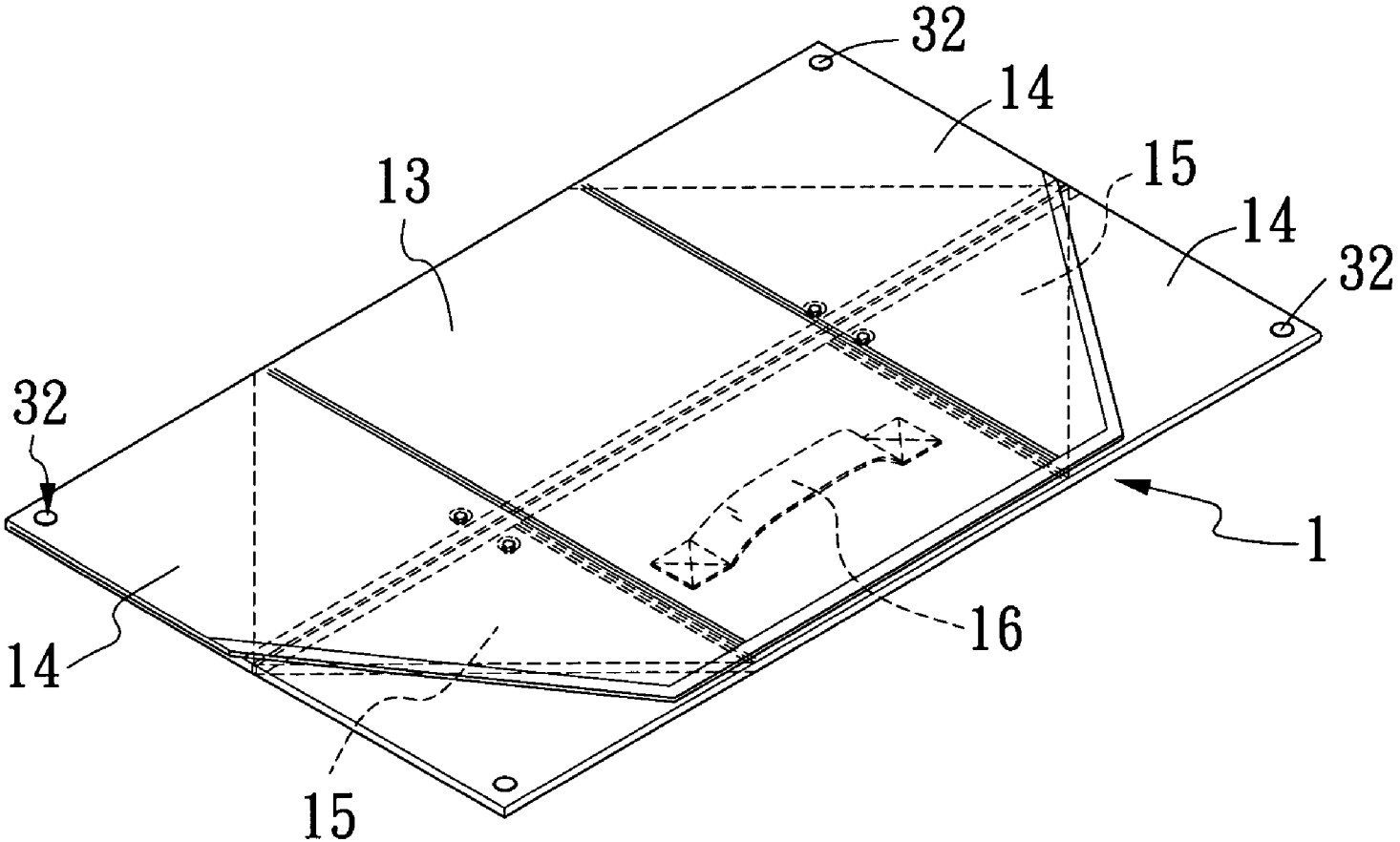
FIG. 9 is a top perspective view of a container according to a second embodiment of the present invention in a collapsed state.
Figure 10:
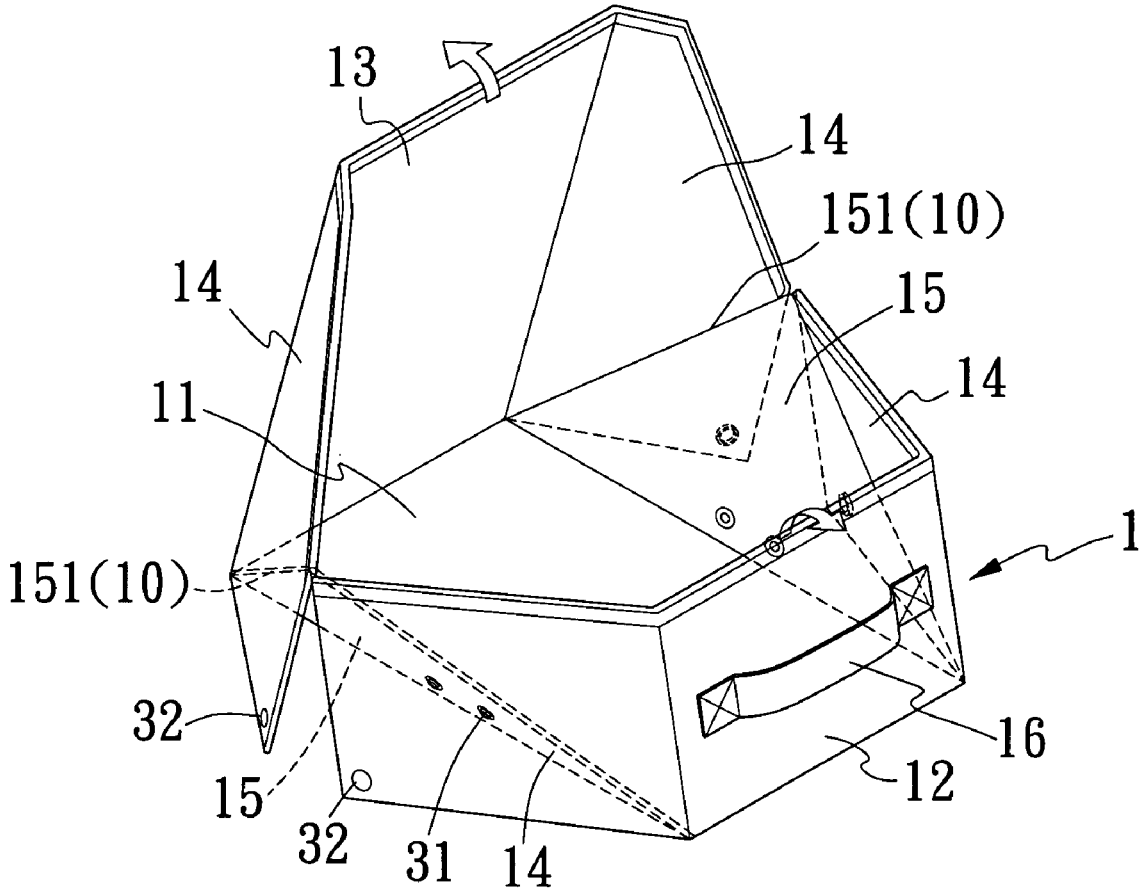
FIG. 10 is a perspective view showing the manner of turning and folding different parts of the collapsed container of FIG. 9 to provide an extended container for use.
Figure 11:
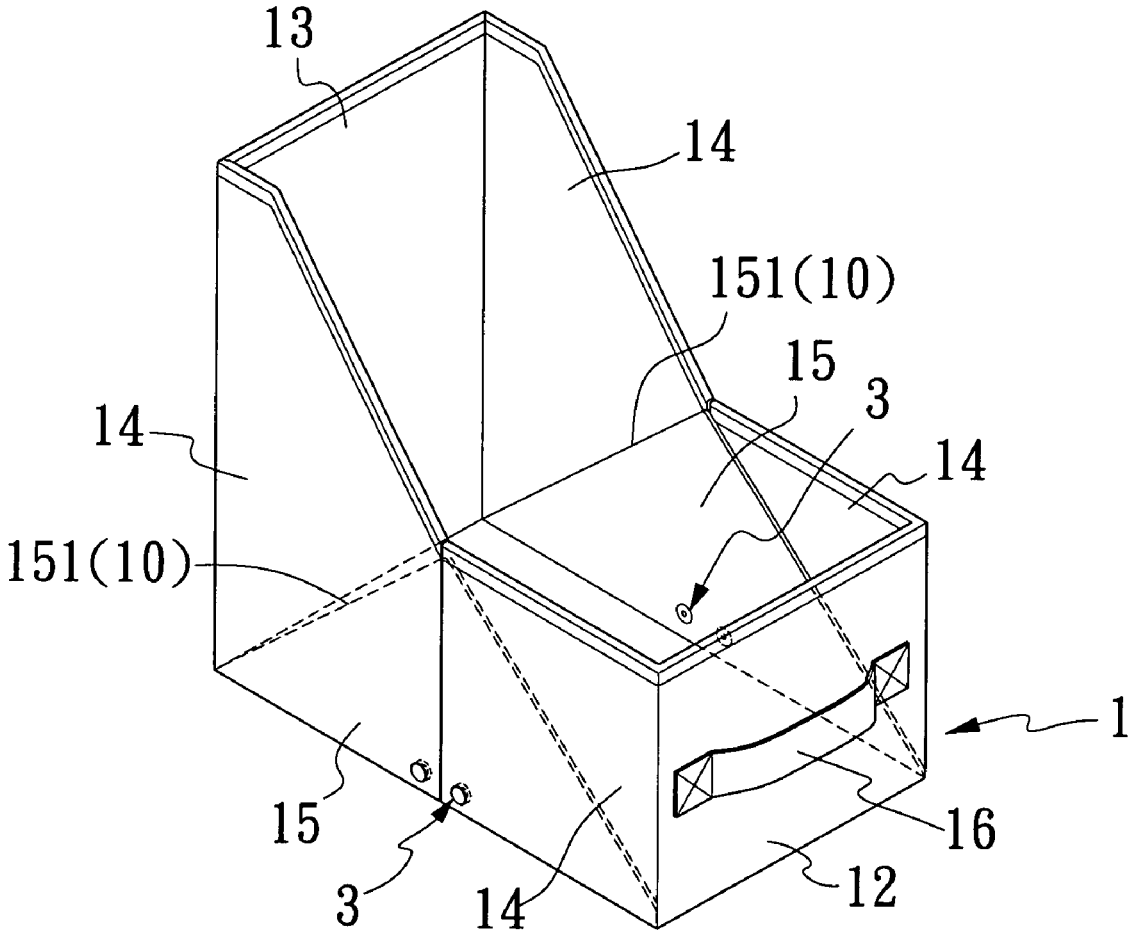
FIG. 11 is a perspective view of the container of the second embodiment of the present invention in a fully extended state for use.

FIGS. 9 to 11 illustrates a collapsible container 1 according to a second embodiment of the present invention. In the second embodiment, the container 1 includes a rear wall 13' higher than a front wall 12, so that two side walls 14' pivotally turnably connected to two lateral edges of the rear wall 13' along two folding lines 10 are two specific trapezoids. Each of the two isosceles triangles of the locating flaps 15 in the second embodiment is connected at one of its two equal lateral sides 151 to an inner surface of the trapezoidal side wall 14'. The container 1 of the second embodiment may be used as a document, book, or magazine folder and is also collapsible to occupy a reduced space, as shown in FIG. 9, and extendable for convenient use, as shown in FIG. 11.

As can be seen from FIGS. 3, 10, and 12, the front wall 12 of the container 1 is provided with a strip-shaped grip 16 having two ends connected to the front wall 12, enabling the container 1 to be more conveniently handled.

What is claimed is:

1. A collapsible container, comprising:

a rectangular bottom;

a front and a rear rectangular wall pivotally turnably connected to a front and a rear edge, respectively, of said bottom along two folding lines;

two rectangular side walls pivotally turnably connected to two lateral ends of each of said front and said rear wall along two folding lines, and each of said side walls having a width, that is, a length of said side wall extended from said lateral end of said front or said rear wall, that does not exceed one half of an overall length of each lateral edge of said bottom between said front and said rear edge;

two locating flaps pivotally turnably connected to two lateral edges of said bottom along two folding lines, each of said two locating flaps being an isosceles triangle having two equal lateral sides separately corresponding to a diagonal of said side wall; and fastening means consisting of two detachably connectable mating fastening elements, said two mating fastening elements being separately mounted on an inner surface of each said side wall and an outer surface of a corresponding one of said locating flaps.

2. The collapsible container as claimed in claim 1, further comprising a collapsible cover cap removably closing an open top of said collapsible container; said collapsible cover cap including a rectangular top; a front and a rear skirt pivotally turnably connected to a front and a rear edge, respectively, of said top along two folding lines; a side skirt pivotally turnably connected to each lateral edge of said top along a folding line; two triangular connecting pieces pivotally turnably connected to two lateral ends of each of said front, rear, and side skirts, any two of said triangular connecting pieces that are adjacent to each other being integrally connected to and foldable toward each other along a folding line; and fastening means consisting of two detachably connectable mating fastening elements, and said mating fastening elements being separately provided on each pair of said adjacent triangular connecting pieces at outer surfaces that would face toward each other after said two adjacent triangular connecting pieces are folded along said folding line to extend into said cover cap.

3. The collapsible container as claimed in claim 1, wherein said rectangular rear wall is higher than said front wall, and said side walls at two lateral ends of said higher rear wall are two trapezoids, and each of said two isosceles triangles of said locating flaps being connected at one of said two equal lateral sides to an inner surface of each said trapezoidal side wall.

4. The collapsible container as claimed in claim 1, wherein said fastening means is a snap consisting of a ball side and a socket side, and said ball side and said socket side being separately and correspondingly fixed to an inner surface of each said side wall and an outer surface of each said locating flap on said container.

5. The collapsible container as claimed in claim 1, wherein said fastening means is a magic tape consisting of a hook tape and a loop tape, and said hook tape and said loop tape being separately and correspondingly fixed to an inner surface of each said side wall and an outer surface of each said locating flap on said container.

6. The collapsible container as claimed in claim 2, wherein said fastening means provided on said collapsible cover cap is a snap consisting of a ball side and a socket side, and said ball side and said socket side being separately and correspondingly fixed to outer surfaces of any two adjacent connecting pieces on said cover cap.

7. The collapsible container as claimed in claim 1, wherein said front wall of said container is provided with a strip-shaped grip having two ends connected to said front wall.

8. The collapsible container as claimed in claim 3, wherein said front wall of said container is provided with a strip-shaped grip having two ends connected to said front wall.

* * * * *